US010945068B2

(12) United States Patent
Deng et al.

(10) Patent No.: US 10,945,068 B2
(45) Date of Patent: Mar. 9, 2021

(54) ULTRASONIC WAVE-BASED VOICE SIGNAL TRANSMISSION SYSTEM AND METHOD

(71) Applicant: Huawei Technologies Co., Ltd., Shenzhen (CN)

(72) Inventors: Chaojun Deng, Shenzhen (CN); Liming Fang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 155 days.

(21) Appl. No.: 16/306,768

(22) PCT Filed: Jun. 3, 2016

(86) PCT No.: PCT/CN2016/084834

§ 371 (c)(1),
(2) Date: Dec. 3, 2018

(87) PCT Pub. No.: WO2017/206193

PCT Pub. Date: Dec. 7, 2017

(65) Prior Publication Data

US 2019/0297416 A1 Sep. 26, 2019

(51) Int. Cl.
*H04R 1/40* (2006.01)
*H04S 7/00* (2006.01)

(52) U.S. Cl.
CPC ..... *H04R 1/403* (2013.01); *H04S 7/303* (2013.01); *H04R 2201/401* (2013.01); *H04R 2217/03* (2013.01)

(58) Field of Classification Search
CPC ..... H04R 1/403; H04R 2201/401; H04R 2217/03; H04S 7/303
(Continued)

(56) References Cited

U.S. PATENT DOCUMENTS

2005/0248233 A1* 11/2005 Pompei ..... G10K 15/02 310/322
2013/0064042 A1 3/2013 Aarts et al.
(Continued)

FOREIGN PATENT DOCUMENTS

CN 201752132 U 2/2011
CN 102893175 A 1/2013
(Continued)

OTHER PUBLICATIONS

Machine Translation and Abstract of Chinese Publication No. CN201752132, dated Feb. 23, 2011, 10 pages.
(Continued)

*Primary Examiner* — Sean H Nguyen
(74) *Attorney, Agent, or Firm* — Conley Rose, P.C.

(57) ABSTRACT

An ultrasonic wave-based voice signal transmission system, where the system includes an ultrasonic modulator, a beamforming controller, an ultrasonic transducer array, and a user detector. The ultrasonic modulator is configured to modulate a voice signal onto an ultrasonic band and output the modulated voice signal to the beamforming controller. The user detector is configured to detect a user and output a detection result of the user to the beamforming controller. The beamforming controller is configured to control according to the detection result from the user detector, a phase and amplitude of the modulated voice signal to obtain an electrical signal pointing to the user, and output, to the ultrasonic transducer array, the electrical signal pointing to the user. Therefore, call convenience can be improved for the user.

20 Claims, 13 Drawing Sheets

(58) Field of Classification Search
USPC ..... 381/182
See application file for complete search history.

(56) References Cited

U.S. PATENT DOCUMENTS

| | | | | |
|---|---|---|---|---|
| 2013/0322674 | A1 | 12/2013 | Ren et al. | |
| 2015/0036848 | A1 | 2/2015 | Donaldson | |
| 2015/0078595 | A1 | 3/2015 | Shintani et al. | |
| 2015/0102994 | A1 | 4/2015 | Ni | |
| 2015/0181361 | A1* | 6/2015 | Stark | H04R 5/04 381/303 |
| 2015/0304789 | A1* | 10/2015 | Babayoff | H04S 7/302 381/303 |
| 2015/0319524 | A1* | 11/2015 | Wang | H04R 3/005 381/92 |
| 2015/0382129 | A1 | 12/2015 | Florencio et al. | |
| 2016/0021454 | A1 | 1/2016 | Liang et al. | |
| 2019/0034155 | A1* | 1/2019 | Ida | G10K 11/28 |

FOREIGN PATENT DOCUMENTS

| | | | |
|---|---|---|---|
| CN | 103165125 | A | 6/2013 |
| CN | 104469491 | A | 3/2015 |
| CN | 105263083 | A | 1/2016 |
| CN | 105612483 | A | 5/2016 |
| JP | 2006081117 | A | 3/2006 |
| WO | 2012122132 | A1 | 9/2012 |
| WO | 2015061345 | A2 | 4/2015 |
| WO | 2015077713 | A1 | 5/2015 |

OTHER PUBLICATIONS

Machine Translation and Abstract of Chinese Publication No. CN103165125, dated Jun. 19, 2013, 24 pages.

Foreign Communication From A Counterpart Application, Chinese Application No. 201680086401.0, Chinese Office Action dated Jun. 27, 2019, 10 pages.

Foreign Communication From A Counterpart Application, PCT Application No. PCT/CN2016/084834, English Translation of International Search Report dated Jan. 3, 2017, 3 pages.

Foreign Communication From A Counterpart Application, PCT Application No. PCT/CN2016/084834, English Translation of Written Opinion dated Jan. 3, 2017, 5 pages.

Machine Translation and Abstract of Japanese Publication No. JP2006081117, dated Mar. 23, 2006, 29 pages.

Foreign Communication From A Counterpart Application, European Application No. 16903578.9, Extended European Search Report dated May 28, 2019, 8 pages.

* cited by examiner

ULTRASONIC WAVE-BASED VOICE SIGNAL TRANSMISSION SYSTEM AND METHOD

CROSS-RELATED TO RELATED APPLICATIONS

This application is a U.S. National Stage of International Patent Application No. PCT/CN2016/084834 filed on Jun. 3, 2016, which is hereby incorporated by reference in its entirety.

TECHNICAL FIELD

The present invention relates to the field of ultrasonic directional transmission technologies, and in particular, to an ultrasonic wave-based voice signal transmission system and method.

BACKGROUND

An existing communications apparatus such as a mobile phone or a computer needs to use a headset or handheld auxiliary, speaker (hands-free) playing, or the like to make a call. A use process of an existing common communications manner brings much inconvenience to a user. For example, the user needs to wear an additional answering device (for example, a headset) to answer the call, and this is relatively inconvenient. For another example, a handheld manner needs to be used for answering a call by using a mobile phone, and answering a call for a long time brings obvious discomfort to the user's hand and also limits an activity of the hand. For still another example, answering a call in a hands-free (speaker) manner brings a problem of poor privacy. These disadvantages result in that it is not convenient for the user to use the existing communications apparatus.

SUMMARY

Embodiments of the present invention provide an ultrasonic wave-based voice signal transmission system and method. A receive user of a voice signal is detected, and the voice signal is directionally transmitted to the receive user by using an ultrasonic wave, so as to improve call convenience for the user.

According to a first aspect, an ultrasonic wave-based voice signal transmission system is provided. The system includes an ultrasonic modulator, a beamforming controller, an ultrasonic transducer array, and a user detector, where the ultrasonic modulator, the user detector, and the ultrasonic transducer array all are connected to the beamforming controller; the ultrasonic modulator is configured to modulate a voice signal onto an ultrasonic band and output the modulated voice signal to the beamforming controller; the user detector is configured to detect a user and output a detection result of the user to the beamforming controller; the beamforming controller is configured to control a phase and an amplitude of the modulated voice signal according to the detection result output by the user detector, to obtain an electrical signal that points to the user, and output, to the ultrasonic transducer array, the signal that points to the user; and the ultrasonic transducer is configured to convert the electrical signal that points to the user and that is output by the beamforming controller into an ultrasonic signal with a beam pointing to the user, and transmit the ultrasonic signal.

According to the voice signal transmission system described in the first aspect, the receive user of the voice signal is detected, and the voice signal is directionally transmitted to the receive user by using an ultrasonic wave, so as to improve call convenience for the user.

In some possible implementations, the ultrasonic transducer array includes m ultrasonic transducers, the beamforming controller includes n transmission controllers, the transmission controller includes a phase controller and an amplitude controller, the transmission controller is connected to the ultrasonic transducer, and the transmission controller is configured to control a phase and an amplitude of a signal output to the ultrasonic transducer, where m and n are positive integers.

This embodiment of the present invention provides three manners of detecting the user. A first manner is detecting the user by using an ultrasonic echo, a second manner is detecting the user in an acoustic source detection manner, and a third manner is detecting the user by using a camera.

In the first detection manner, to detect the user by using the ultrasonic echo, the voice signal transmission system may further include a system controller, where

- the system controller may be configured to output a scan trigger instruction to the beamforming controller to trigger the beamforming controller to output a scan pulse signal;
- the beamforming controller may be further configured to respond to the scan trigger instruction, and output the scan pulse signal to the ultrasonic transducer array in a specified scan mode, so that the ultrasonic transducer array transmits an ultrasonic scan pulse that is used to detect the user. Herein, in the specified scan mode, a time interval (a pulse interval) between two adjacent scan pulses, transmit power of a scan pulse, a shape and duration of a scan pulse, and the like may be limited; and
- the user detector may be specifically configured to detect the user according to an echo of the ultrasonic scan pulse and output the detection result of the user to the beamforming controller.

In the foregoing first detection manner, the user detector may include an echo receiver array and an echo analyzer, where the echo receiver array is connected to the echo analyzer, and the echo analyzer is connected to the beamforming controller;

- the echo receiver array may be configured to receive an echo that is formed after the ultrasonic scan pulse is reflected by an object, and convert the echo into an electrical signal; and
- the echo analyzer may be configured to analyze, according to a signal characteristic of the electrical signal, whether the detected object is the user, and output the detection result of the user to the beamforming controller.

In the foregoing first detection manner, the detection result may be decision information (such as detection succeeds or detection fails).

Specifically, the echo analyzer may be configured to: when recognizing the user according to the signal characteristic of the electrical signal, output, to the beamforming controller, a detection result used to indicate that detection succeeds. In this case, the beamforming controller may be specifically configured to control, according to a currently used phase and amplitude, the phase and the amplitude of the modulated signal output by the ultrasonic modulator.

In the foregoing first detection manner, the detection result may be location information of the user.

Specifically, the echo analyzer may be configured to obtain a location of the user according to the signal characteristic of the electrical signal by means of analysis, and output the location information of the user to the beamforming controller. Correspondingly, the beamforming controller may be specifically configured to control, according to the location information of the user, the phase and the amplitude of the modulated signal output by the ultrasonic modulator.

In a possible implementation of the foregoing first detection manner, the echo receiver array is the ultrasonic transducer array.

The second detection manner is as follows:

The user detector may include a voice signal receiver array and a voice analyzer, where the voice signal receiver array is connected to the voice analyzer, and the voice analyzer is connected to the beamforming controller;

- the voice signal receiver array may be configured to receive an external voice signal;
- the voice analyzer may be configured to obtain, by means of analysis, a location of the user according to a signal characteristic of the external voice signal and output location information of the user to the beamforming controller; and
- the beamforming controller may be specifically configured to control, according to the location information of the user output by the voice analyzer, the phase and the amplitude of the modulated signal output by the ultrasonic modulator.

In the foregoing second detection manner, the detection result is the location information of the user output by the voice analyzer.

In the foregoing second detection manner, further, the voice analyzer may be further configured to analyze a voice characteristic of the external voice signal, and determine, according to the voice characteristic, whether the external voice signal is from the user.

The third detection manner is as follows:

The user detector may include a camera array and an image analyzer, where the camera array is connected to the image analyzer, and the image analyzer is connected to the beamforming controller;

- the camera array may be configured to collect an image signal;
- the image analyzer may be configured to obtain a location of the user according to a signal characteristic of the image signal by means of analysis and output location information of the user to the beamforming controller; and
- the beamforming controller may be specifically configured to control, according to the location information of the user output by the image analyzer, the phase and the amplitude of the modulated signal output by the ultrasonic modulator.

In the foregoing third detection manner, the detection result is the location information of the user output by the voice analyzer.

In this embodiment of the present invention, in some possible implementations, if the detection result is the location information of the user, the beamforming controller may be specifically configured to: obtain, from a preset table, a phase and an amplitude that are corresponding to the location information of the user, and control, according to the phase and the amplitude that are corresponding to the location of the user, the phase and the amplitude of the modulated signal output by the ultrasonic modulator, where the preset table may include a location, and a phase and an amplitude that are corresponding to the location, and the phase and the amplitude are used to indicate a beam that points to the location and that is generated by the beamforming controller.

Optionally, the preset table may include all locations to which an ultrasonic beam transmitted by the ultrasonic transducer array is able to point, and phases and amplitudes that are used by the beamforming controller when the ultrasonic beam points to all the locations one by one.

In this embodiment of the present invention, in some possible implementations, if the detection result is the location information of the user, the beamforming controller may run a neural network algorithm, where the location of the user is used as an input of the neural network, and an output obtained by the beamforming controller is a phase and an amplitude that point to the location of the user. Herein, the neural network is a trained neural network. During training of the neural network, a large quantity of locations are used as an input, and known phases and amplitudes that are used to point to the locations are used as an output.

According to a second aspect, an ultrasonic wave-based voice signal transmission method is provided. The method includes: modulating a voice signal onto an ultrasonic band to obtain the modulated signal; detecting a user, and controlling a phase and an amplitude of the modulated signal according to a detection result, to generate a signal that points to the user; and transmitting, by using an ultrasonic wave and by using an ultrasonic transducer array, the signal that points to the user.

With reference to the second aspect, in a possible implementation, the detecting a user may include: transmitting, by using the ultrasonic transducer array, an ultrasonic scan pulse that is used to scan the user; and analyzing, according to an echo of the ultrasonic scan pulse, whether a detected object is the user, and outputting the detection result.

With reference to the second aspect, in another possible implementation, the detecting a user may include: receiving an external voice signal by using a voice receiver array, and obtaining location information of the user according to a signal characteristic of the external voice signal by means of analysis, where the detection result is the location information of the user.

In the foregoing another possible implementation, the method may further include: analyzing a voice characteristic of the external voice signal, and determining, according to the voice characteristic, whether the external voice signal is from the user.

With reference to the second aspect, in still another possible implementation, the detecting a user may include: collecting an image signal by using a camera array, and obtaining location information of the user according to a signal characteristic of the image signal by means of analysis, where the detection result is the location information of the user.

With reference to the second aspect, in some possible implementations, the detection result is decision information and is used to indicate that detection succeeds. Specifically, the phase and the amplitude of the modulated signal may be controlled in the following manner: controlling the phase and the amplitude of the modulated signal according to a currently used phase and amplitude, to generate the signal that points to the user.

With reference to the second aspect, in some possible implementations, the detection result is the location information of the user. Specifically, the phase and the amplitude of the modulated signal may be controlled in the following manner: controlling the phase and the amplitude of the modulated signal according to the location information of the user, to generate the signal that points to the user.

If the detection result is the location information of the user, specifically, the phase and the amplitude of the modulated signal may be controlled in the following manner: obtaining, from a preset table, a phase and an amplitude that are corresponding to the location information of the user, and controlling the phase and the amplitude of the modulated signal according to the phase and the amplitude that are corresponding to the location of the user, to generate the signal that points to the user, where the preset table may include a location, and a phase and an amplitude that are corresponding to the location, and the phase and the amplitude are used to indicate a beam that points to the location and that is generated by the beamforming controller.

Optionally, the preset table includes all locations to which an ultrasonic beam transmitted by the ultrasonic transducer array is able to point, and phases and amplitudes that are used by the beamforming controller when the ultrasonic beam points to all the locations one by one.

According to a third aspect, a voice signal transmission apparatus is provided. The apparatus includes a functional unit configured to execute the method according to the second aspect.

According to a fourth aspect, a computer storage medium is provided. The computer storage medium stores program code. The program code includes an instruction used to implement any possible implementation of the method according to the second aspect.

According to the embodiments of the present invention, the receive user of the voice signal is detected, and the voice signal is directionally transmitted to the receive user by using an ultrasonic wave, so as to improve call convenience for the user.

BRIEF DESCRIPTION OF DRAWINGS

To describe the technical solutions in the embodiments of the present invention more clearly, the following briefly describes the accompanying drawings required for describing the embodiments.

DESCRIPTION OF EMBODIMENTS

Terms used in the part of the implementations of the present invention are merely intended to explain specific embodiments of the present invention, but are not intended to limit the present invention.

Based on an existing technical problem, the embodiments of the present invention provide an ultrasonic wave-based voice signal transmission system. A receive user of a voice signal is detected, and the voice signal is directionally transmitted to the receive user by using an ultrasonic wave, so as to improve call convenience for the user.

The solution of the present invention mainly uses the following principle: A voice signal is transmitted to a user by using a directional propagation characteristic of an ultrasonic wave, and a direction of an ultrasonic beam is controlled according to a real-time location of the user, to ensure that the ultrasonic beam points to the user.

It should be understood that an ultrasonic wave-based audio directional propagation technology is a new acoustic source technology in which a sound can be propagated in a specific direction in a form of a beam. As an ultrasonic wave has good directivity, a human ear basically cannot receive the ultrasonic wave or hear any sound when the human ear is not within a range of an ultrasonic beam. A basic principle of a directional propagation technology is that an audible sound signal is modulated onto an ultrasonic carrier signal and the modulated signal is transmitted to air by using an ultrasonic transducer. During a process in which ultrasonic waves of different frequencies propagate in air, due to a nonlinear acoustic effect of air, these signals interact with each other and perform self-demodulation, further generating new sound waves whose frequencies are a sum of original ultrasonic frequencies (a sum frequency) and a difference between original ultrasonic frequencies (a difference frequency). If an appropriate ultrasonic wave is selected, a difference-frequency sound wave may fall within an area of an audible sound. In this way, with high directivity of the ultrasonic wave itself, a directional propagation process of a sound is implemented.

The following describes the embodiments of the present invention in detail with reference to the accompanying drawings.

Figure 1:
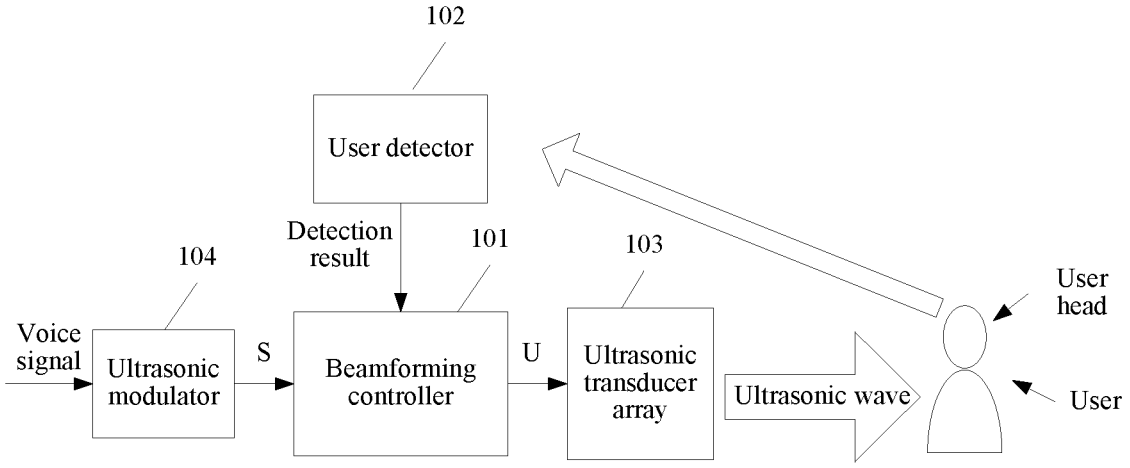
FIG. 1 is a schematic structural diagram of a first voice signal transmission system according to an embodiment of the present invention.

Referring to FIG. 1, FIG. 1 is a schematic structural diagram of an ultrasonic wave-based voice signal transmission system according to an embodiment of the present invention. The voice signal transmission system may be a device that integrates a voice transmission function, for example, a mobile phone, a computer, or a smart speaker. As shown in FIG. 1, the voice signal transmission system includes a beamforming controller 101, a user detector 102, an ultrasonic transducer array 103, and an ultrasonic modulator 104. The ultrasonic modulator 104, the user detector 102, and the ultrasonic transducer array 103 all are connected to the beamforming controller 101.

The ultrasonic modulator 104 is configured to modulate a voice signal onto an ultrasonic band and output the modulated voice signal S to the beamforming controller 101. In specific implementation, an amplitude modulation mode of a carrier may be used. An ultrasonic carrier frequency greater than about 40 kHz is selected. In an actual application, a different carrier frequency, for example, 60 kHz or 200 kHz, may be selected according to a specific requirement (for example, a device size and a power requirement). As the amplitude modulation mode of a carrier is a quite mature technology, details are not described herein.

The user detector 102 is configured to detect a user and output a detection result of the user to the beamforming controller 101. In this embodiment of the present invention, the user detector 102 may detect the user by using an ultrasonic echo, detect the user by using a voice signal sent by the user, or detect the user in a manner of combining echo detection and voice detection. For specific implementation of the user detector 102, reference may be made to subsequent content.

The beamforming controller 101 is configured to control a phase and an amplitude of the modulated voice signal S according to the detection result output by the user detector 102, to obtain a signal U that points to the user, and output, to the ultrasonic transducer array 103, the signal U that points to the user, to generate an ultrasonic signal that points to the user. For specific implementation of the beamforming controller 101, reference may be made to FIG. 2.

The ultrasonic transducer array 103 is configured to convert the signal U that points to the user and that is output by the beamforming controller 101 into an ultrasonic signal, and transmit the ultrasonic signal. It should be understood that in a transmission process of the ultrasonic signal, due to a nonlinear demodulation characteristic of air, the user can hear the voice signal, ensuring a complete call.

Figure 2:
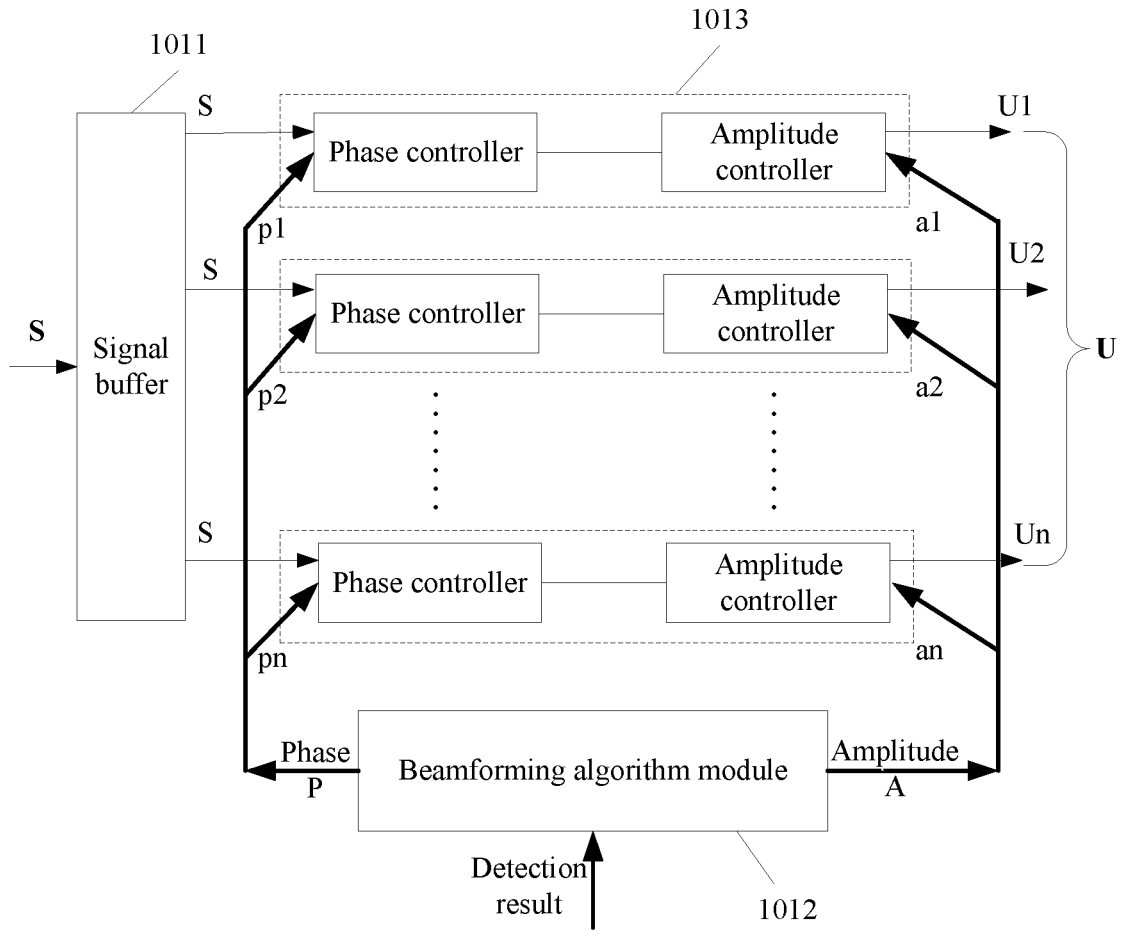
FIG. 2 is a schematic structural diagram of a beamforming controller according to an embodiment of the present invention.

In this embodiment of the present invention, as shown in FIG. 2, the beamforming controller 101 may include a signal buffer 1011, a beamforming algorithm module 1012, and n transmission controllers 1013, where n is a positive integer.

The signal buffer 1011 may be configured to copy an input signal S, for example, perform copying to obtain n input signals S, and output the n copied input signals S to the n transmission controllers 1013, respectively. A phase and an amplitude of each input signal S are controlled by one transmission controller 1013.

The beamforming algorithm module 1012 may be configured to output a phase control parameter P and an amplitude control parameter A, where both P and A are vectors ($P=[p_1, p_2, \ldots, p_n]$ and $A=[a_1, a_2, \ldots, a_n]$). Each pair of vector elements P and A, for example, $(p_i, a_i)$, is used to control a phase and an amplitude of one input signal S, to obtain a signal $U_i$. $U_1, U_2, \ldots, U_n$ are superimposed to generate an output signal U. It may be understood that if appropriate values are selected for P and A, a beam that is generated when the output signal U drives the transducer array points to the user. For specific implementation of the beamforming algorithm module 1012, reference may be made to subsequent embodiments corresponding to FIG. 4 and FIG. 5.

The transmission controller 1013 includes a phase controller and an amplitude controller. The transmission controller 1013 is connected to an ultrasonic transducer and is configured to control a phase and an amplitude of the signal $U_i$ output to the ultrasonic transducer. In an actual application, an internal structure of the transmission controller 1013 is not limited by FIG. 2, and may be adjusted according to a specific requirement.

The ultrasonic transducer array 103 may include m ultrasonic transducers, where m is a positive integer. In specific implementation, one transmission controller 1013 may be connected to one ultrasonic transducer (that is, n=m), or one transmission controller 1013 may be connected to at least two ultrasonic transducers (that is, n<m). This is not limited in this embodiment of the present invention.

Figure 3A:
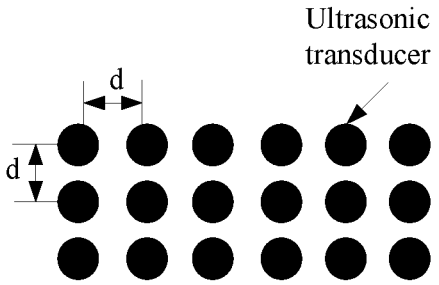
FIG. 3A and FIG. 3B are schematic structural diagrams of two ultrasonic transducer arrays according to an embodiment of the present invention.
Figure 3B:
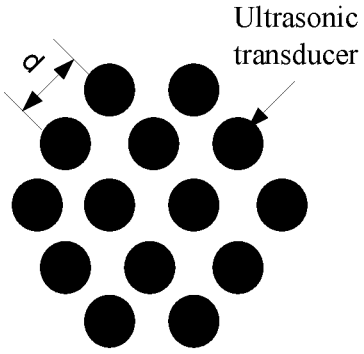

As shown in FIG. 3A, the ultrasonic transducer array 103 is formed by a group of regularly arranged ultrasonic transducers. As shown in FIG. 3A, the ultrasonic transducer array 103 is a 3×6 array, including a total of 18 ultrasonic transducers. The signals $U_1, U_2, \ldots, U_n$ output by the beamforming controller 101 each are connected to one ultrasonic transducer, that is, n=18. In an actual application, an arrangement form of the ultrasonic transducer array 103 is not limited by FIG. 3A, may be shown in FIG. 3B, or may be another arrangement form. It should be understood that more transducers included in the ultrasonic transducer array 103 leads to better directivity of a formed ultrasonic beam and higher accuracy of beam scanning.

It should be noted that intervals (d) between adjacent ultrasonic transducers in the ultrasonic transducer array 103 should better be kept the same, and the interval (d) is less than one half of a wavelength corresponding to an ultrasonic wave. For example, if a 100 kHz ultrasonic wave is used, a wavelength of the 100 kHz ultrasonic wave is 3.4 mm, and the interval (d) should better be less than 1.7 mm. The example is merely used to explain this embodiment of the present invention and should not constitute a limitation.

This embodiment of the present invention provides three manners of detecting the user. A first manner is detecting the user by using an ultrasonic echo, a second manner is detecting the user in an acoustic source detection manner, and a third manner is detecting the user by using a camera.

Figure 4:
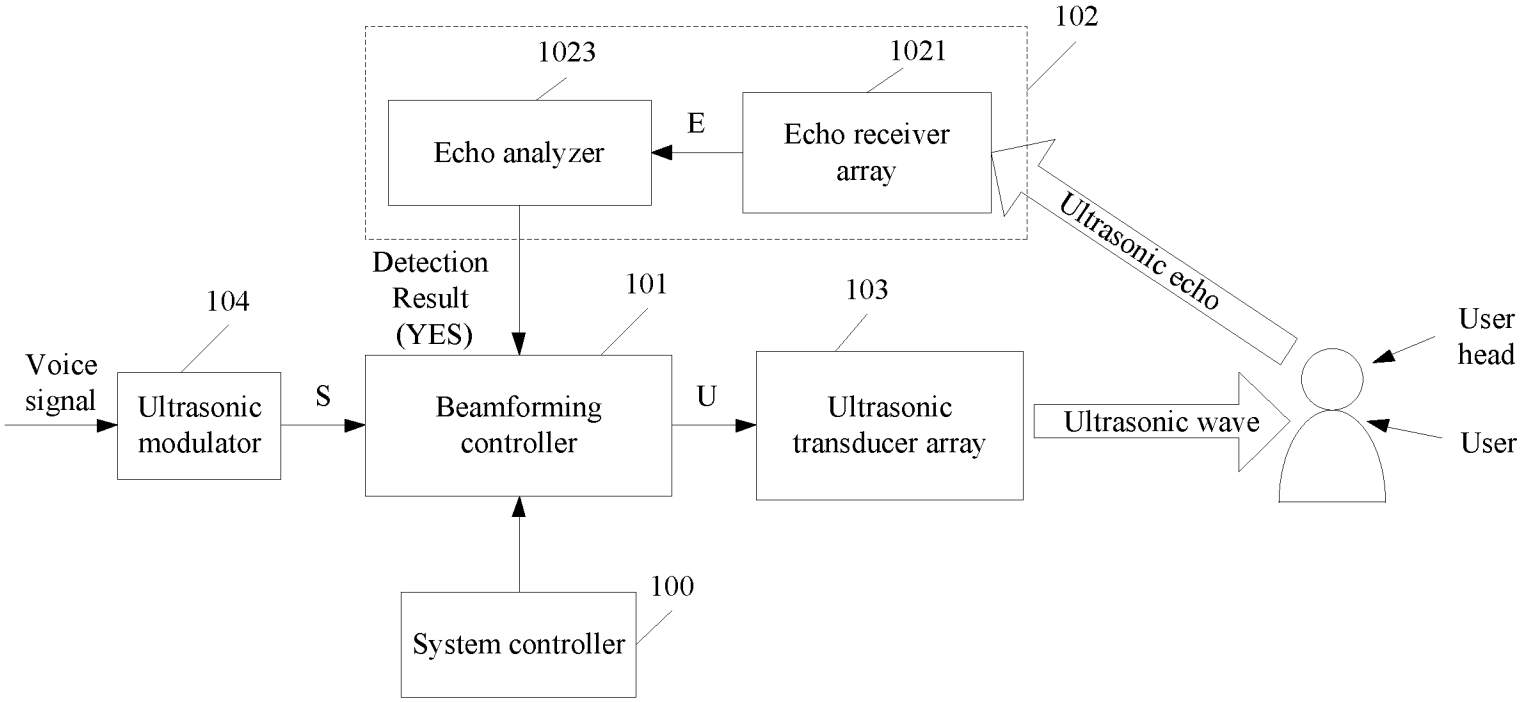
FIG. 4 is a schematic principle diagram of an ultrasonic echo detection manner according to an embodiment of the present invention.
Figure 5:
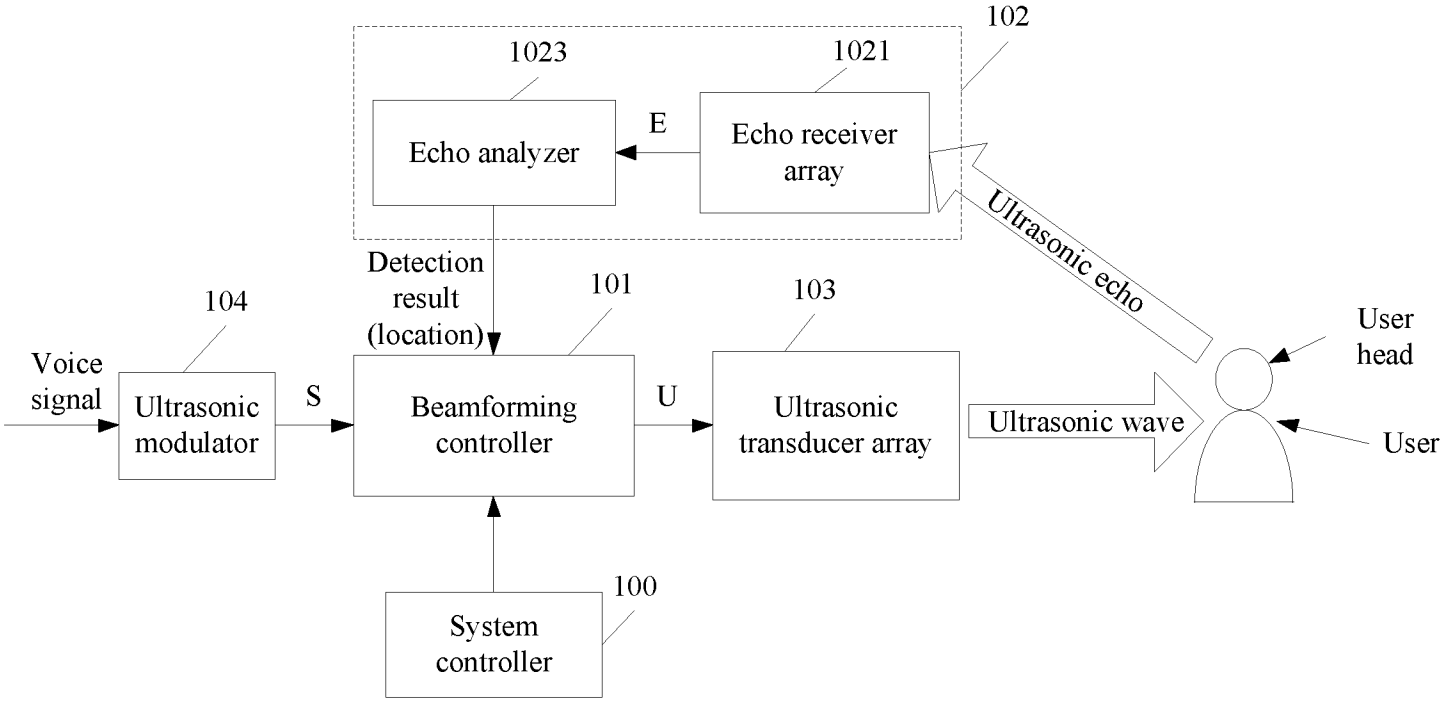
FIG. 5 is a schematic principle diagram of another ultrasonic echo detection manner according to an embodiment of the present invention.

With reference to FIG. 4 and FIG. 5, the following describes in detail the first detection manner provided by this embodiment of the present invention. It should be understood that an ultrasonic wave may form an ultrasonic echo when being reflected by an obstacle (for example, the user). A two-dimensional or three-dimensional image of an object may be obtained according to an ultrasonic echo that is formed by means of reflection by the object. In this case, it may be determined, according to the image, what the obstacle reflecting the ultrasonic echo is, and location information of the obstacle, for example, a distance and a direction, may be obtained by means of analysis. The following describes in detail how the voice signal transmission system detects the user by using the ultrasonic echo.

As shown in FIG. 4, to detect the user by using the ultrasonic echo, the voice signal transmission system may further include a system controller 100.

The system controller 100 is configured to output a scan trigger instruction to the beamforming controller 101 to trigger the beamforming controller 101 to output a scan pulse signal.

The beamforming controller 101 is further configured to respond to the scan trigger instruction, and output the scan pulse signal to the ultrasonic transducer array 103 in a specified scan mode, so that the ultrasonic transducer array 103 transmits an ultrasonic scan pulse that is used to detect the user. Herein, in the specified scan mode, a time interval (a pulse interval) between two adjacent scan pulses, transmit power of a scan pulse, and a shape and duration of a scan pulse, and the like may be limited.

The user detector 102 may be specifically configured to detect the user according to an echo of the ultrasonic scan pulse and output the detection result of the user to the beamforming controller 101. It should be understood that once the user (or another obstacle) is detected by using the ultrasonic scan pulse transmitted by the ultrasonic transducer array 103, the ultrasonic scan pulse is reflected, and the ultrasonic echo is formed. The detection result of the user may be decision information (such as detection succeeds or detection fails), or may be location information of the user. For specific implementation of the detection result, reference may be made to subsequent content.

Specifically, as shown in FIG. 4, the user detector 102 may include an echo receiver array 1021 and an echo analyzer 1023. The echo receiver array 1021 is connected to the echo analyzer 1023, and the echo analyzer 1023 is connected to the beamforming controller 101.

The echo receiver array 1021 is configured to receive an echo that is formed after the ultrasonic scan pulse is reflected by an object, and convert the echo into an electrical signal E. The echo receiver array 1021 may include multiple echo receivers. Each echo receiver can receive echoes with different delays or strength. Optionally, the echo receiver array 1021 may process only a signal received during the pulse interval. In some possible implementations, the ultrasonic transducer array 103 may be the echo receiver array 1021.

The echo analyzer 1023 is configured to analyze, according to a signal characteristic of the electrical signal E, whether the detected object is the user, and output the detection result of the user to the beamforming controller 101. The electrical signal E is a vector ($E=[e_1, e_2, \ldots, e_n]$), where one vector element indicates an electrical signal that is converted from an echo received by an echo receiver. In specific implementation, the echo analyzer 1023 may form an image according to signals E received during multiple consecutive pulse intervals, and determine whether the image is an image of the user (more precisely, a head of the user). If the image is the image of the user, the echo analyzer 1023 may further obtain a location of the user according to the signals E by means of analysis.

In this embodiment of the present invention, the beamforming controller 101 may determine, according to the following implementations, a phase control parameter P and an amplitude control parameter A that are used to point to the user.

In an implementation of this embodiment of the present invention, as shown in FIG. 4, the detection result that is of the user and that is output by the user detector 102 may be decision information (such as detection succeeds or detection fails).

Specifically, the echo analyzer 1023 may be configured to: when recognizing the user (more precisely, the head of the user) according to the signal characteristic of the electrical signal E, output a detection result such as "detection succeeds" to the beamforming controller 101, to instruct the beamforming controller 101 to control, according to a currently used phase and amplitude, a phase and an amplitude of the modulated signal S output by the ultrasonic modulator 104.

Herein, the detection result such as "detection succeeds" indicates that a beam generated under current control of the beamforming controller 101 points to the user. That is, the phase control parameter P and the amplitude control parameter A that are currently used by the beamforming controller 101 can enable the ultrasonic signal output by the ultrasonic transducer 103 to point to the user. It should be noted that the detection result "detection succeeds" indicates that detection succeeds, and may be specifically represented as a character string "YES", a bit value "1", or another computer expression form. This is not limited in this embodiment of the present invention.

In another implementation of this embodiment of the present invention, as shown in FIG. 5, the detection result that is of the user and that is output by the user detector 102 may be the location information of the user.

Specifically, the echo analyzer 1023 may be configured to obtain a location of the user according to the signal characteristic of the electrical signal E by means of analysis, and output the location information of the user to the beamforming controller 101, to instruct the beamforming controller 101 to control, according to the location information of the user, the phase and the amplitude of the modulated signal S output by the ultrasonic modulator 104.

Figure 6:
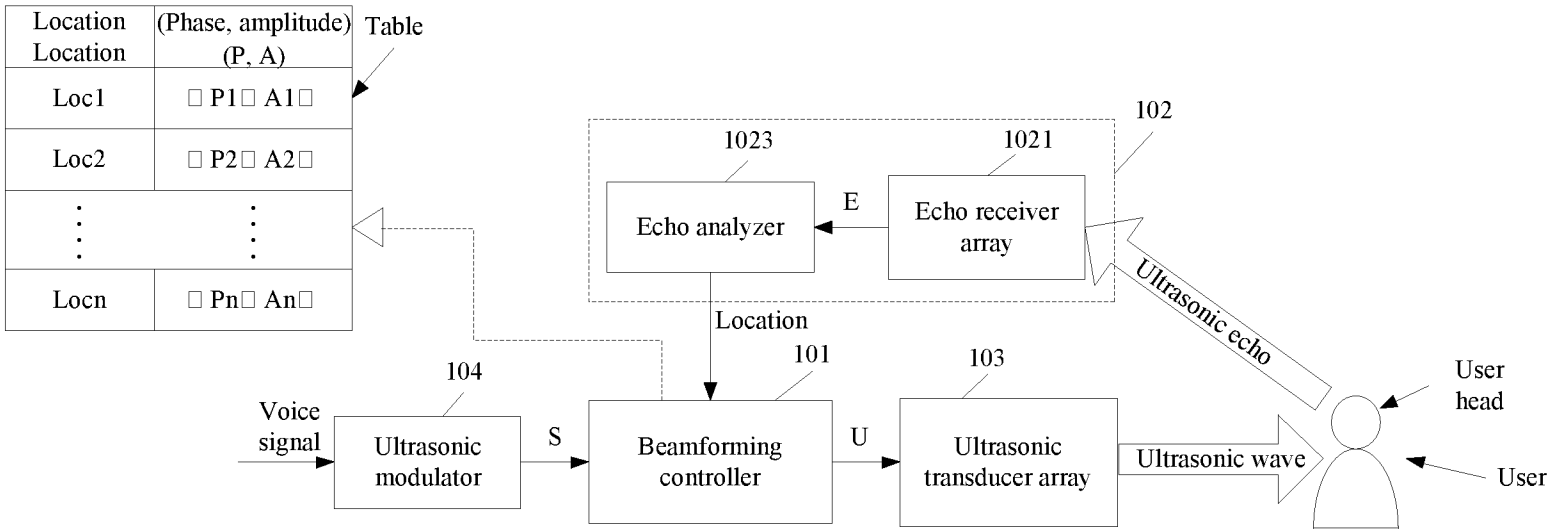
FIG. 6 is a schematic diagram of a working manner of a beamforming controller according to an embodiment of the present invention.
Figure 7:
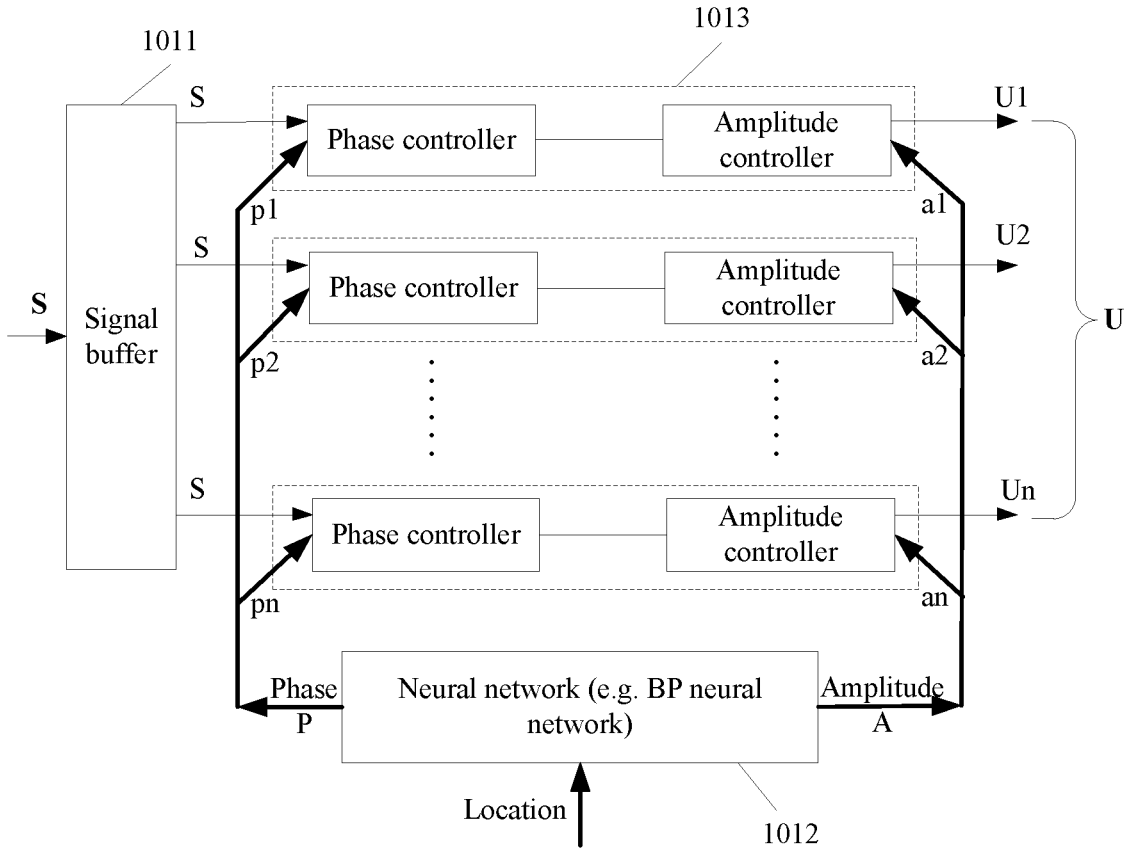
FIG. 7 is a schematic diagram of another working manner of a beamforming controller according to an embodiment of the present invention.

With reference to FIG. 6 and FIG. 7, the following describes, in the implementation shown in FIG. 5, how the beamforming controller 101 specifically determines, according to the location information of the user, a phase control parameter P and an amplitude control parameter A that are used to point to the user.

In a possible implementation, as shown in FIG. 6, the beamforming controller 101 may be specifically configured to: obtain, from a preset table, a phase and an amplitude that are corresponding to the location information of the user, and control, according to the phase and the amplitude that are corresponding to a location of the user, the phase and the amplitude of the modulated signal S output by the ultrasonic modulator 104, to generate a beam that points to the user, to further generate, by using the ultrasonic transducer 103, an ultrasonic beam that points to the user, finally implementing directional transmission intended for the user.

Specifically, the preset table may include a location, and a phase and an amplitude that are corresponding to the location. The phase and the amplitude are used to indicate a beam that points to the location and that is generated by the beamforming controller 101. For example, as shown in FIG. 6, a phase and an amplitude (P2, A2) are used to indicate a beam that points to a location "Loc2" and that is generated by the beamforming controller 101. The example is merely used to explain this embodiment of the present invention and should not constitute a limitation.

Optionally, the table may include all locations to which an ultrasonic beam transmitted by the ultrasonic transducer array 103 is able to point, and phases P and amplitudes A that are used by the beamforming controller 101 when the ultrasonic beam points to all the locations one by one. It should be understood that due to a limitation of hardware design, a range that can be covered by the ultrasonic beam transmitted by the ultrasonic transducer array 103 in the voice signal transmission system is limited, and a location to which an ultrasonic beam transmitted by the voice signal transmission system is able to point is also limited. Therefore, the table may be obtained in an experimental manner.

It should be noted that the preset table may be locally stored in the voice signal transmission system, or may be stored in an external device (for example, a server) that is corresponding to the voice signal transmission system. This is not limited in this embodiment of the present invention, as long as the beamforming controller 101 can access the table.

In another possible implementation, as shown in FIG. 7, in the beamforming controller 101, the beamforming algorithm module 1021 may specifically run a neural network algorithm, for example, a BP (Back Propagation, back propagation) neural network algorithm. In this embodiment of the present invention, the neural network is a trained neural network. During training of the neural network, a large quantity of locations are used as an input, and known phases P and amplitudes A that are used to point to the locations are used as an output. For example, the table shown in FIG. 6 is used to train the neural network. In this way, when the echo analyzer 1023 outputs the location information of the user to the neural network, the neural network can calculate a phase P and an amplitude A that are used to point to the user.

Figure 8:
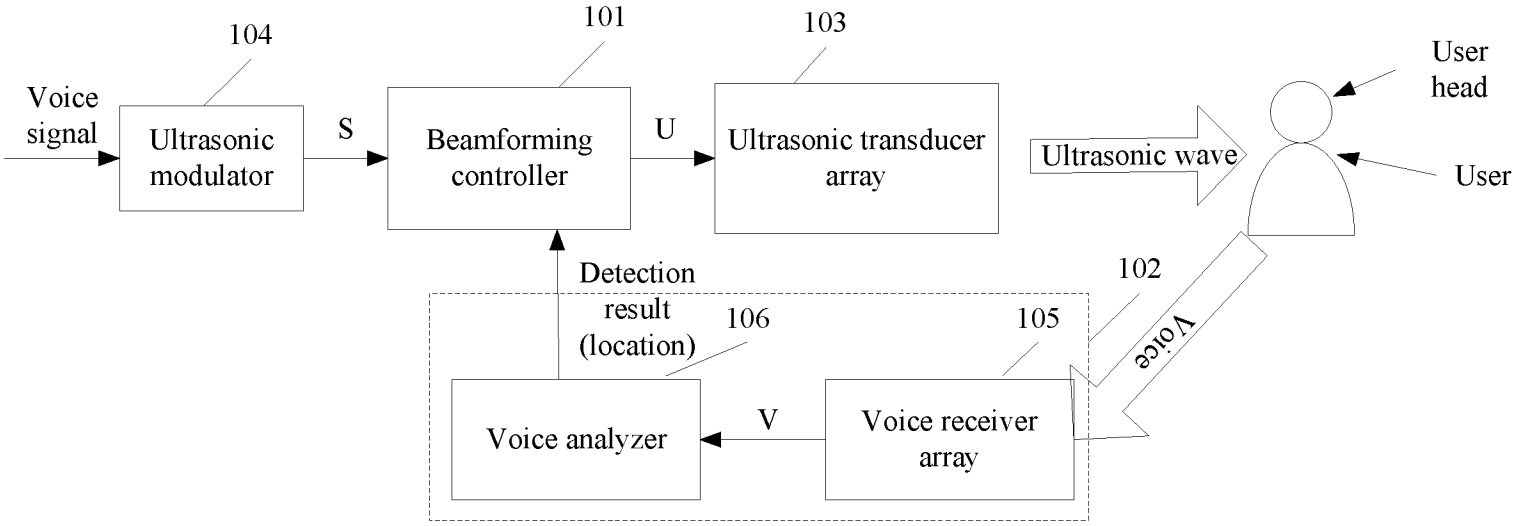
FIG. 8 is a schematic structural diagram of a second voice signal transmission system according to an embodiment of the present invention.

With reference to FIG. 8, the following describes in detail the second detection manner provided by this embodiment of the present invention.

As shown in FIG. 8, the user detector 102 in the voice signal transmission system may include a voice signal receiver array 105 and a voice analyzer 106. The voice signal receiver array 105 is connected to the voice analyzer 106, and the voice analyzer 106 is connected to the beamforming controller 101.

The voice signal receiver array 105 is configured to receive an external voice signal V. The signal V is a vector ($V=[v_1, v_2, \ldots, v_m]$), where m is a positive integer and indicates a quantity of voice receivers included in the voice signal receiver array 105.

The voice analyzer 106 is configured to obtain, by means of analysis, a location of the user according to a signal characteristic of the external voice signal V and output location information of the user to the beamforming controller 101, to instruct the beamforming controller 101 to control, according to the location information of the user, the phase and the amplitude of the modulated signal S output by the ultrasonic modulator 104, to generate a beam that points to the user, and further generate, by using the ultrasonic transducer 103, an ultrasonic beam that points to the user, finally implementing directional transmission intended for the user.

In an embodiment shown in FIG. 8, the detection result that is output by the user detector 102 to the beamforming controller 101 is the location information of the user. The location information of the user may be represented by using a vector of a distance between the user and each voice receiver, or may be represented in another manner. This is not limited herein.

Figure 9:
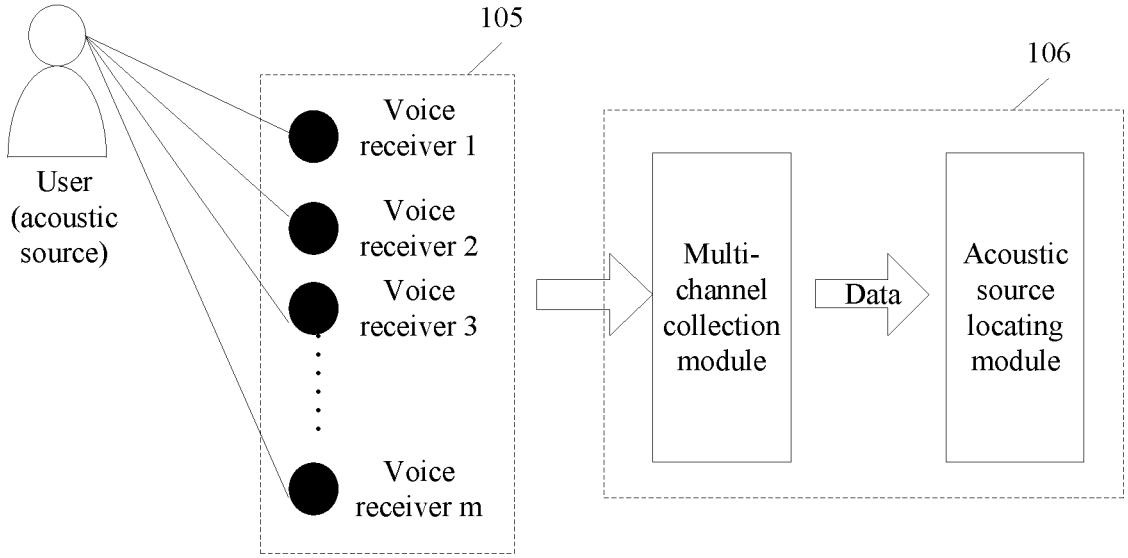
FIG. 9 is a schematic principle diagram of an acoustic source detection manner according to an embodiment of the present invention.

As shown in FIG. 9, the voice signal receiver array 105 includes multiple voice receivers, and all voice receivers each may be configured to receive a sound made by the user, together forming multiple voice signals. As shown in FIG. 9, the voice analyzer 106 may include an acoustic source locating module, which may be configured to estimate a location of an acoustic source and output the estimated acoustic source location to the beamforming controller 101, to instruct the beamforming controller 101 to control, according to the estimated location, the phase and the amplitude of the modulated signal S output by the ultrasonic modulator 104, to generate a beam that roughly points to the acoustic source. It should be noted that an arrangement manner of the voice signal receiver array 105 may be a rectangular arrangement manner or may be an annular arrangement manner. This is not limited herein.

For how the beamforming controller 101 determines, according to the location information of the user output by the voice analyzer 106, a phase control parameter P and an amplitude control parameter A that are used to point to the user, reference may be made to implementations in the foregoing content that are corresponding to FIG. 6 and FIG. 7, and details are not described herein.

In a noisy environment, the voice signal receiver array 105 possibly receives sounds made by multiple acoustic sources (including the user). To accurately locate the user, the voice analyzer 106 may be further configured to analyze a voice characteristic of the external voice signal, and determine, according to the voice characteristic, whether the external voice signal is from the user. In this case, a voice characteristic of the user is generally configured for the voice analyzer 106. It should be noted that the voice characteristic of the user may be locally stored in the voice signal transmission system, or may be stored in an external device (for example, a server) that is corresponding to the voice signal transmission system. This is not limited in this embodiment of the present invention, as long as the voice analyzer 106 can access the voice characteristic of the user.

Figure 10:
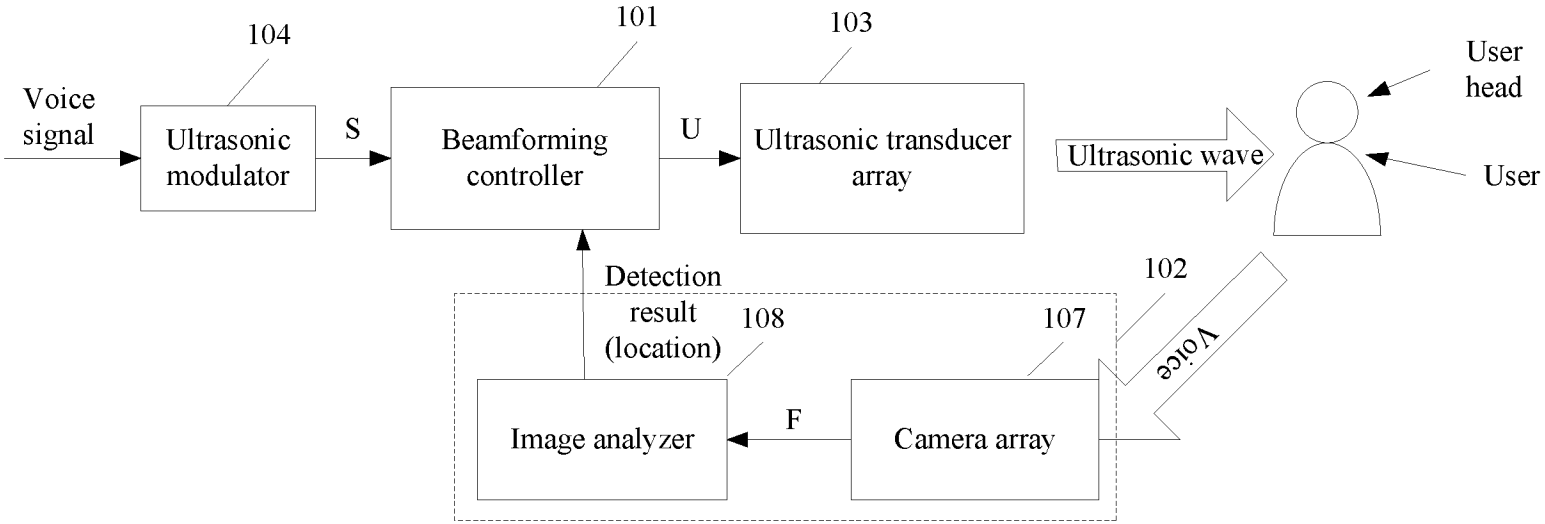
FIG. 10 is a schematic structural diagram of a third voice signal transmission system according to an embodiment of the present invention.

With reference to FIG. 10, the following describes in detail the third detection manner provided by this embodiment of the present invention.

As shown in FIG. 10, the user detector 102 in the voice signal transmission system may include a camera array 107 and an image analyzer 108. The camera array 107 is connected to the image analyzer 108, and the image analyzer 108 is connected to the beamforming controller 101.

The camera array 107 is configured to collect an image signal F. The signal F is a vector ($F=[f_1, f_2, \ldots, f_k]$), where k is a positive integer and indicates a quantity of cameras included in the camera array 107.

The image analyzer 108 is configured to obtain a location of the user according to a signal characteristic of the image signal F by means of analysis and output location information of the user to the beamforming controller 101, to instruct the beamforming controller 101 to control, according to the location information of the user, the phase and the amplitude of the modulated signal S output by the ultrasonic modulator 104, to generate a beam that points to the user, and further generate, by using the ultrasonic transducer 103, an ultrasonic beam that points to the user, finally implementing directional transmission intended for the user.

Figure 11:
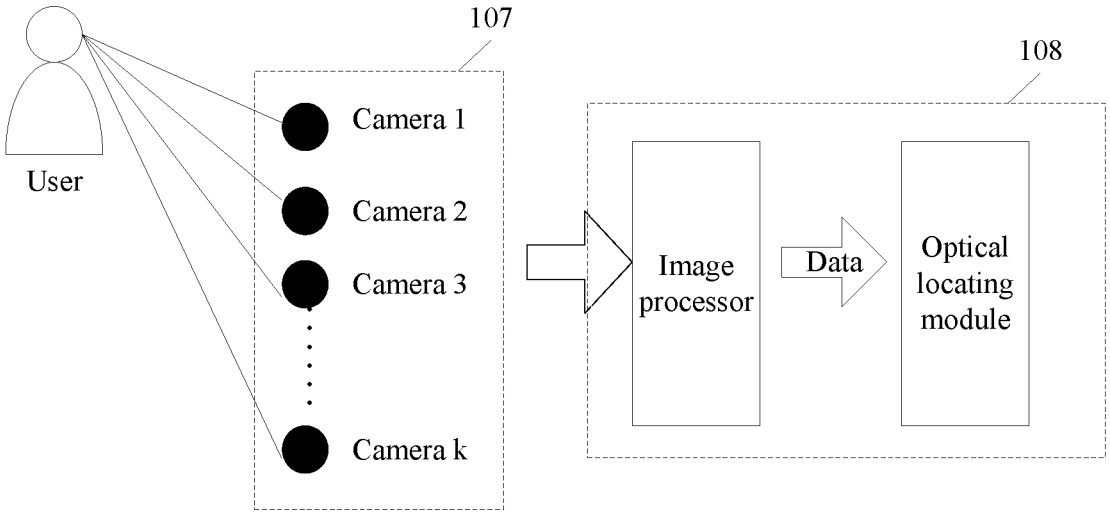
FIG. 11 is a schematic principle diagram of a camera detection manner according to an embodiment of the present invention.

As shown in FIG. 11, the camera array 107 includes multiple cameras, all cameras each may be configured to collect an external image, together obtaining image information in a range covered by the multiple cameras. As shown in FIG. 11, the image analyzer 108 may include an optical locating module, which may be configured to determine a location of the user in the range covered by the multiple cameras. For example, when the camera array 107 is a pair of bionic cameras (that is, k=2), the optical locating module may determine a direction of the user by using a triangular ranging method. It should be noted that an arrangement manner of the camera array 107 may be a straight-line arrangement manner, or may be an annular arrangement manner. This is not limited herein.

For how the beamforming controller 101 determines, according to the location information of the user output by the image analyzer 108, a phase control parameter P and an amplitude control parameter A that are used to point to the user, reference may be made to implementations in the foregoing content that are corresponding to FIG. 6 and FIG. 7, and details are not described herein.

In addition to separate implementation of three detection manners that are respectively corresponding to FIG. 4, FIG. 8, and FIG. 11, the three detection manners may be combined for implementation in this embodiment of the present invention. Especially in a crowded environment, the user detector 102 may detect multiple human heads (including the user) in an ultrasonic echo detection manner. To accurately detect the user from the crowded environment, the embodiments of the present invention further provide an embodiment in which the foregoing two detection manners are combined, and reference may be made to FIG. 12.

Figure 12:
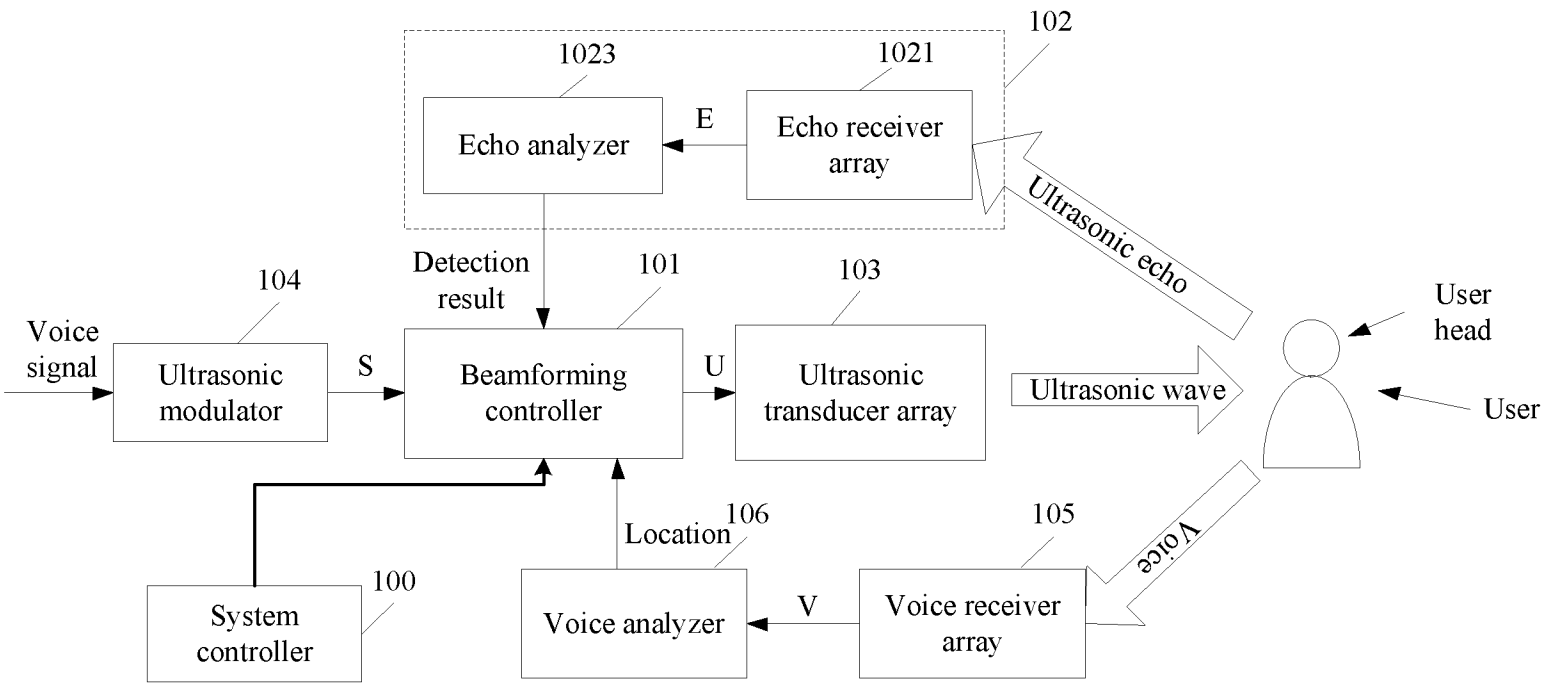
FIG. 12 is a schematic structural diagram of a fourth voice signal transmission system according to an embodiment of the present invention.

As shown in FIG. 12, when the user detector 102 detects multiple human bodies (or human heads) by using an ultrasonic echo, the user detector 102 may output a detection result "detection fails" to the beamforming controller 101. The user generally speaks during a call process, especially when the user does not hear the other party. Therefore, the voice analyzer 106 may estimate location information of the user according to an external voice signal received by the voice receiver array 105, and output an estimated acoustic source location to the beamforming controller 101, to instruct the beamforming controller 101 to control, according to the estimated location, the phase and the amplitude of the modulated signal S output by the ultrasonic modulator 104, to generate a beam that roughly points to the acoustic source. In this way, an ultrasonic beam that points to the user can also be generated in the crowded environment.

It should be noted that in the crowded environment, when the user detector 102 possibly detects the multiple human bodies (or human heads), the user detector 102 may alternatively use a person closest to the voice signal transmission system as the user, and output location information of the closest person to the beamforming controller 101, so that the beamforming controller 101 may control generation of a beam that points to the closest person, and further an ultrasonic beam that points to the closest person is generated by using the ultrasonic transducer 103. In this way, a probability that detection succeeds can also be effectively improved.

In addition, it may be understood that under a condition that the voice receiver array 105 does not receive a voice signal sent by the user, the beamforming controller 101 needs to control an ultrasonic beam to perform scanning in a relatively wide range to detect the user. As a result, a relatively long time is consumed. Therefore, under a condition that the voice receiver array 105 receives the voice signal sent by the user, the voice analyzer 106 may output an estimated rough direction of the user to the beamforming controller 101. When receiving a scan trigger instruction sent by the system controller 100, the beamforming controller 101 may directly transmit a scan pulse signal to the rough direction, to implement detection of the user in a local range, further improving detection efficiency.

After the user is successfully detected, due to mobility of the user, the system controller 100 may be configured to constantly instruct the beamforming controller 101 to transmit the scan pulse signal, so that the ultrasonic transducer array 103 transmits an ultrasonic scan pulse, to detect the user in a moving state. In addition, the user detector 102 may be configured to constantly detect the user according to a detection manner described in the foregoing content, and feed back a detection result to the beamforming controller 101, so that the beamforming controller 101 controls generation of an ultrasonic signal that points to the user.

Figure 13:
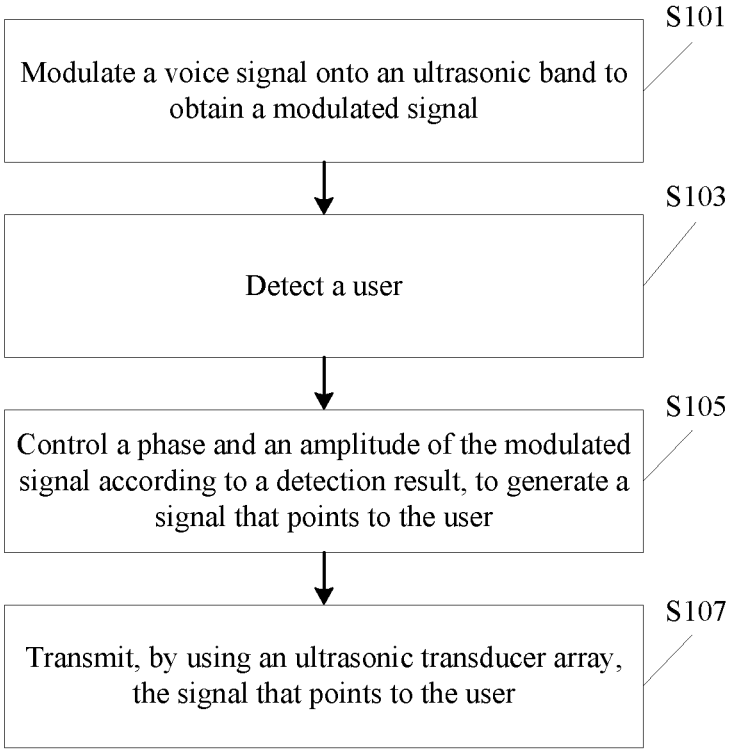
FIG. 13 is a schematic flowchart of an ultrasonic wave-based voice signal transmission method according to an embodiment of the present invention.

Based on a same inventive concept, an embodiment of the present invention further provides an ultrasonic wave-based voice signal transmission method. The method may be executed by the voice signal transmission system described in the foregoing content. As shown in FIG. 13, the method includes:

S101: Modulate a voice signal onto an ultrasonic band to obtain the modulated signal.

S103: Detect a user. In this embodiment of the present invention, the user may be detected by using an ultrasonic echo, the user may be detected by using a voice signal sent by the user, or the user may be detected in a manner of combining echo detection and voice detection.

S105: Control a phase and an amplitude of the modulated signal according to a detection result, to generate a signal that points to the user. In this embodiment of the present invention, the detection result may be decision information (such as detection succeeds or detection fails), or may be location information of the user. For specific implementation of the detection result, reference may be made to the foregoing content.

S107: Transmit, by using an ultrasonic transducer array, the signal that points to the user.

In an implementation, S103 may be executed in an ultrasonic echo detection manner, specifically including: transmitting, by using the ultrasonic transducer array, an ultrasonic scan pulse that is used to scan the user; and analyzing, according to an echo of the ultrasonic scan pulse, whether a detected object is the user, and outputting the detection result.

Specifically, for specific implementation of detecting the user in the ultrasonic echo detection manner, reference may be made to an implementation detail of the voice signal transmission system, and details are not described herein.

In another implementation, S103 may be executed in an acoustic source detection manner, specifically including: receiving an external voice signal by using a voice receiver array, and obtaining location information of the user according to a signal characteristic of the external voice signal by means of analysis. Herein, the detection result is the location information of the user.

Specifically, for specific implementation of detecting the user in the acoustic source detection manner, reference may be made to an implementation detail of the voice signal transmission system, and details are not described herein.

In this embodiment of the present invention, if the detection result is decision information used to indicate that detection succeeds, specifically, the phase and the amplitude of the modulated signal may be controlled in the following manner: controlling the phase and the amplitude of the modulated signal according to a currently used phase and amplitude, to generate the signal that points to the user.

In this embodiment of the present invention, if the detection result is the location information of the user, specifically, the phase and the amplitude of the modulated signal may be controlled in the following manner: controlling the phase and the amplitude of the modulated signal according to the location information of the user, to generate the signal that points to the user.

Specifically, for specific implementation of controlling the phase and the amplitude of the modulated signal according to the detection result, reference may be made to an implementation detail of the voice signal transmission system, and details are not described herein.

It should be noted that according to the foregoing detailed descriptions of the embodiments in FIG. 1 to FIG. 12, a person skilled in the art can clearly know an implementation of the ultrasonic wave-based voice signal transmission method. For content not mentioned in the embodiment in FIG. 13, reference may be made to specific descriptions in the embodiments in FIG. 1 to FIG. 12, and details are not described herein.

In addition, based on a same inventive concept, an embodiment of the present invention further provides a voice signal transmission apparatus. The voice signal transmission apparatus includes a function module configured to execute each step in the foregoing method described in the method embodiment in FIG. 13.

Various variation manners and specific examples in the foregoing method described in the embodiment of FIG. 13 are also applicable to the voice signal transmission apparatus. According to the foregoing detailed description of the embodiment in FIG. 13, a person skilled in the art can clearly know an implementation of the voice signal transmission apparatus. Therefore, for brevity of the specification, details are not described herein.

In conclusion, according to the voice signal transmission apparatus provided by this embodiment of the present invention, a receive user of a voice signal is detected, a signal beam that points to the user is controlled to be generated according to location information of the user, and finally the signal beam that points to the user is converted into an ultrasonic signal, and the ultrasonic signal is transmitted. In this way, the voice signal can be directionally transmitted to the user by using an ultrasonic wave that points to the user, so as to improve call convenience for the user.

A person skilled in the art can make various modifications and variations to the present invention without departing from the spirit and scope of the present invention. The present invention is intended to cover these modifications and variations provided that they fall within the scope of protection defined by the following claims and their equivalent technologies.

What is claimed is:

1. An ultrasonic wave-based voice signal transmission system, comprising:

a beamforming controller;

an ultrasonic modulator coupled to the beamforming controller and configured to:

modulate a voice signal onto an ultrasonic band; and output the modulated voice signal to the beamforming controller;

a user detector coupled to the beamforming controller and configured to:

detect a user; and output a detection result of the user to the beamforming controller, wherein the detection result is a location information of the user, and wherein the user detector comprises:

a voice signal receiver array configured to receive an external voice signal; and a voice analyzer coupled to the beamforming controller and the voice signal receiver array and configured to:

obtain, by analysis, the location information of the user according to a signal characteristic of the external voice signal; and output the location information of the user to the beamforming controller, wherein the beamforming controller is configured to:

control a phase and an amplitude of the modulated voice signal according to the location information of the user received from the voice analyzer to obtain an electrical signal pointing to the user; and output the electrical signal pointing to the user to an ultrasonic transducer array, and wherein the ultrasonic transducer array is coupled to the beamforming controller and configured to:

convert the electrical signal pointing to the user received from the beamforming controller into an ultrasonic signal with a beam pointing to the user; and transmit the ultrasonic signal.

2. The ultrasonic wave-based voice signal transmission system of claim 1, wherein the ultrasonic transducer array comprises m ultrasonic transducers, wherein the beamforming controller comprises n transmission controllers, wherein a transmission controller comprises a phase controller and an amplitude controller, wherein the transmission controller is coupled to at least one ultrasonic transducer and configured to control a signal phase and a signal amplitude of a signal output to the ultrasonic transducer array, and wherein the m and the n are positive integers.

3. The ultrasonic wave-based voice signal transmission system of claim 1, further comprising a system controller coupled to the beamforming controller and configured to output a scan trigger instruction to the beamforming controller, wherein the beamforming controller is further configured to:

respond to the scan trigger instruction; and output a scan pulse signal to the ultrasonic transducer array in a specified scan mode, wherein the ultrasonic transducer array is further configured to transmit an ultrasonic scan pulse scanning the user, and wherein the user detector being is further configured to:

detect the user according to an ultrasonic scan pulse echo; and output the detection result of the user to the beamforming controller.

4. The ultrasonic wave-based voice signal transmission system of claim 3, wherein the user detector further comprises:

an echo receiver array coupled to a mode recognizer, wherein the mode recognizer is coupled to the beamforming controller, and wherein the echo receiver array is configured to:

receive an echo formed after the ultrasonic scan pulse is reflected from an object; and convert the echo into the electrical signal; and an echo analyzer configured to:

analyze, according to a signal characteristic of the electrical signal, whether the object is the user; and output the detection result of the user to the beamforming controller.

5. The ultrasonic wave-based voice signal transmission system of claim 4, wherein the detection result of the user comprises decision information, wherein the echo analyzer is further configured to output the detection result to the beamforming controller indicating detection success when recognizing the user according to the signal characteristic of the electrical signal, and wherein the beamforming controller is further configured to control, according to a currently used phase and a currently used amplitude, the modulated voice signal phase and the modulated voice signal amplitude.

6. The ultrasonic wave-based voice signal transmission system of claim 4, wherein the detection result of the user is location information of the user, wherein the echo analyzer is further configured to:

obtain, by analysis, the location information of the user according to the signal characteristic of the electrical signal; and output the location information of the user to the beamforming controller, and wherein the beamforming controller is further configured to control, according to the location information of the user, the phase and the amplitude of the modulated voice signal.

7. The ultrasonic wave-based voice signal transmission system of claim 6, wherein the beamforming controller is further configured to:

obtain, from a first table, a phase and an amplitude corresponding to the location information of the user; and control, according to the phase and the amplitude corresponding to the location information of the user, the phase and the amplitude of the modulated voice signal to generate the beam pointing to the user, wherein the first table comprises a location, and the phase and the amplitude corresponding to the location, and wherein the phase and the amplitude corresponding to the location indicate that the beam is pointing to the location.

8. The ultrasonic wave-based voice signal transmission system of claim 7, wherein the first table comprises all locations to which an ultrasonic beam from the ultrasonic transducer array is able to point, and phases and amplitudes used by the beamforming controller when the ultrasonic beam points to all the locations one by one.

9. The ultrasonic wave-based voice signal transmission system of claim 1, wherein the voice analyzer is further configured to:

analyze a voice characteristic of the external voice signal; and determine, according to the voice characteristic, whether the external voice signal is from the user.

10. The ultrasonic wave-based voice signal transmission system of claim 1, wherein the detection result of the user is location information of the user, wherein the user detector comprises:

a camera array configured to collect an image signal; and an image analyzer coupled to the camera array and configured to:

obtain, by analysis, the location information of the user according to a signal characteristic of the image signal; and output the location information of the user to the beamforming controller, and wherein the beamforming controller is further configured to control, according to the location information of the user received from the image analyzer, the phase and the amplitude of the modulated voice signal.

11. An ultrasonic wave-based voice signal transmission method, comprising:

modulating a voice signal onto an ultrasonic band to obtain a modulated signal;

detecting a user comprising:

receiving an external voice signal using a voice receiver array; and obtaining, by analysis, location information of the user according to a first signal characteristic of the external voice signal;

controlling a modulated signal phase and a modulated signal amplitude according to a detection result to generate a second signal pointing to the user, wherein the detection result is the location information of the user; and transmitting, using an ultrasonic wave and an ultrasonic transducer array, the signal pointing to the user.

12. The ultrasonic wave-based voice signal transmission method of claim 11, wherein detecting the user further comprises:

transmitting, using the ultrasonic transducer array, an ultrasonic scan pulse scanning the user;

analyzing, according to an echo of the ultrasonic scan pulse, whether a detected object is the user; and outputting the detection result.

13. The ultrasonic wave-based voice signal transmission method of claim 11, further comprising:

analyzing a voice characteristic of the external voice signal; and determining, according to the voice characteristic, whether the external voice signal is from the user.

14. The ultrasonic wave-based voice signal transmission method of claim 11, wherein detecting the user further comprises:

collecting an image signal using a camera array; and obtaining, by analysis, location information of the user according to a third signal characteristic of the image signal.

15. The ultrasonic wave-based voice signal transmission method of claim 11, wherein the detection result is decision information indicating detection success, and wherein controlling the modulated signal phase and the modulated signal amplitude comprises controlling the modulated signal phase and the modulated signal amplitude according to a currently used phase and a currently used amplitude to generate the second signal pointing to the user.

16. The ultrasonic wave-based voice signal transmission method of claim 11, wherein controlling the modulated signal phase and the modulated signal amplitude of the modulated signal comprises controlling the modulated signal phase and the modulated signal amplitude according to the location information of the user to generate the second signal pointing to the user.

17. The ultrasonic wave-based voice signal transmission method of claim 11, wherein controlling the modulated signal phase and the modulated signal amplitude of the modulated signal comprises:

obtaining, from a preset table, a phase and an amplitude corresponding to the location information of the user; and controlling the modulated signal phase and the modulated signal amplitude according to the phase and the amplitude corresponding to the location information of the user to generate the second signal pointing to the user, wherein the preset table comprises a location, and the phase and the amplitude corresponding to the location, and wherein the phase and the amplitude corresponding to the location indicates a beam pointing to the location generated by a beamforming controller.

18. A voice signal transmission apparatus, comprising:

a memory comprising instructions; and a processor coupled to the memory, wherein the instructions cause the processor to be configured to:

modulate a voice signal onto an ultrasonic band to obtain a modulated signal;

detect a user, wherein in a manner to detect the user, the instructions further cause processor to be configured to:

receive an external voice signal using a voice receiver array; and obtain, by analysis, location information of the user according to a signal characteristic of the external voice signal;

control a modulated signal phase and a modulated signal amplitude according to a detection result to generate a signal pointing to the user, wherein the detection result is the location information of the user; and transmit, using an ultrasonic wave and an ultrasonic transducer array, the signal pointing to the user.

19. The voice signal transmission apparatus of claim 18, wherein in a manner to detect the user, the instructions further cause the processor to be configured to:

transmit, using the ultrasonic transducer array, an ultrasonic scan pulse scanning the user;

analyze, according to an echo of the ultrasonic scan pulse, whether a detected object is the user; and output the detection result.

20. The voice signal transmission apparatus of claim 18, wherein the instructions further cause the processor to be configured to:

analyze a voice characteristic of the external voice signal; and determine, according to the voice characteristic, whether the external voice signal is from the user.

* * * * *